US007663566B2

(12) United States Patent
Engel

(10) Patent No.: US 7,663,566 B2
(45) Date of Patent: Feb. 16, 2010

(54) DUAL POLARIZATION PLANAR ARRAY ANTENNA AND CELL ELEMENTS THEREFOR

(75) Inventor: Benjamin M. Engel, Haifa (IL)

(73) Assignee: Starling Advanced Communications Ltd., Yoqneam (IL)

( * ) Notice: Subject to any disclaimer, the term of this patent is extended or adjusted under 35 U.S.C. 154(b) by 542 days.

(21) Appl. No.: 11/440,054

(22) Filed: May 25, 2006

(65) Prior Publication Data

US 2007/0085744 A1 Apr. 19, 2007

(30) Foreign Application Priority Data

Oct. 16, 2005 (IL) ..... 171450
Mar. 26, 2006 (IL) ..... 174549

(51) Int. Cl.
*H01Q 13/00* (2006.01)
*H01Q 1/38* (2006.01)

(52) U.S. Cl. ..... 343/772; 343/700 MS; 343/872

(58) Field of Classification Search ..... None
See application file for complete search history.

(56) References Cited

U.S. PATENT DOCUMENTS 3,810,185 A 5/1974 Wilkinson
4,263,598 A 4/1981 Bellee et al.
4,486,758 A 12/1984 de Ronde
4,527,165 A 7/1985 de Ronde
4,614,947 A 9/1986 Rammos
4,647,938 A 3/1987 Roederer et al.
4,679,051 A 7/1987 Yabu et al.
4,801,943 A 1/1989 Yabu et al.
5,089,824 A 2/1992 Uematsu et al.
5,245,348 A 9/1993 Nishikawa et al.
5,309,162 A 5/1994 Uematsu et al.

(Continued)

FOREIGN PATENT DOCUMENTS

EP 0089084 9/1983

(Continued)

OTHER PUBLICATIONS

LeVine, et al., "Component Design Trends—Dual-Mode Horn Feed for Microwave Multiplexing," *Electronics*, vol. 27, pp. 162-164 (Sep. 1954).

(Continued)

*Primary Examiner*—Trinh V Dinh
(74) *Attorney, Agent, or Firm*—Nixon & Vanderhye PC

(57) ABSTRACT

An RF antenna structure (e.g., a planar array) includes at least one radiation cell (and typically many, e.g., 16 or 32 or 64, etc.) having a conductive enclosure and an upper probe and a lower probe located at different heights within the enclosure. The enclosure between the upper probe and a bottom of the cell has at least two different cross-sectional areas. The upper and lower probes are preferably oriented at substantially 90° relative to each other. An upper portion of the enclosure beneath the upper probe may have a larger dimension than a lower portion such that the upper portion allows propagation of waves generated by the upper probe in a predetermined frequency band while the lower portion (e.g., above the lower probe) does not substantially allow propagation of waves generated by the upper probe, in the predetermined frequency band.

26 Claims, 4 Drawing Sheets

U.S. PATENT DOCUMENTS 5,398,035 A 3/1995 Densmore et al.
5,404,509 A 4/1995 Klein
5,420,598 A 5/1995 Uematsu et al.
5,508,731 A 4/1996 Kohorn
5,512,906 A * 4/1996 Speciale ..... 342/375
5,528,250 A 6/1996 Sherwood et al.
5,537,141 A 7/1996 Happer et al.
5,544,299 A 8/1996 Wenstrand et al.
5,579,019 A 11/1996 Uematsu et al.
5,596,336 A 1/1997 Liu
5,678,171 A 10/1997 Toyama et al.
5,712,644 A 1/1998 Kolak
5,740,035 A 4/1998 Cohen et al.
5,751,247 A 5/1998 Nomoto et al.
5,764,199 A 6/1998 Ricardi
5,767,897 A 6/1998 Howell
5,781,163 A 7/1998 Ricardi et al.
5,799,151 A 8/1998 Hoffer
5,801,754 A 9/1998 Ruybal et al.
5,823,788 A 10/1998 Lemelson et al.
5,841,980 A 11/1998 Waters et al.
5,861,881 A 1/1999 Freeman et al.
5,872,545 A 2/1999 Rammos
5,878,214 A 3/1999 Gilliam et al.
5,880,731 A 3/1999 Liles et al.
5,886,671 A 3/1999 Riemer et al.
5,916,302 A 6/1999 Dunn et al.
5,917,310 A 6/1999 Baylis
5,929,819 A 7/1999 Grinberg
5,961,092 A 10/1999 Coffield
5,978,835 A 11/1999 Ludwig et al.
5,982,333 A 11/1999 Stillinger et al.
5,983,071 A 11/1999 Gagnon et al.
5,991,595 A 11/1999 Romano et al.
5,995,951 A 11/1999 Ferguson
5,999,208 A 12/1999 McNerney et al.
6,049,306 A 4/2000 Amarillas
6,061,082 A 5/2000 Park
6,061,440 A 5/2000 Delaney et al.
6,061,716 A 5/2000 Moncreiff
6,064,978 A 5/2000 Gardner et al.
6,074,216 A 6/2000 Cueto
6,078,948 A 6/2000 Podgorny et al.
6,120,534 A 9/2000 Ruiz
6,124,832 A 9/2000 Jeon et al.
6,160,520 A 12/2000 Muhlhauser et al.
6,169,522 B1 1/2001 Ma et al.
6,184,828 B1 2/2001 Shoki
6,191,734 B1 2/2001 Park et al.
6,195,060 B1 2/2001 Spano et al.
6,204,823 B1 3/2001 Spano et al.
6,218,999 B1 4/2001 Bousquet et al.
6,249,809 B1 6/2001 Bro
6,256,663 B1 7/2001 Davis
6,259,415 B1 7/2001 Kumpfbeck et al.
6,297,774 B1 10/2001 Chung
6,304,861 B1 10/2001 Ferguson
6,331,837 B1 12/2001 Shattil
6,347,333 B2 2/2002 Eisendrath et al.
6,407,714 B1 6/2002 Butler et al.
6,442,590 B1 8/2002 Inala et al.
6,483,472 B2 11/2002 Cipolla et al.
6,486,845 B2 11/2002 Ogawa et al.
6,496,158 B1 12/2002 Ksienski et al.
6,578,025 B1 6/2003 Pollack et al.
6,624,787 B2 * 9/2003 Puzella et al. ..... 343/700 MS
6,657,589 B2 12/2003 Wang et al.
6,661,388 B2 12/2003 Desargant et al.
6,677,908 B2 1/2004 Strickland
6,707,432 B2 3/2004 Strickland
6,738,024 B2 5/2004 Butler et al.
6,765,542 B2 7/2004 McCarthy et al.
6,771,225 B2 8/2004 Tits
6,778,144 B2 8/2004 Anderson
6,792,448 B1 9/2004 Smith
6,822,612 B2 11/2004 Takimoto et al.
6,839,039 B2 1/2005 Tanaka et al.
6,861,997 B2 3/2005 Mahon
6,864,837 B2 3/2005 Runyon et al.
6,864,846 B2 3/2005 King
6,873,301 B1 3/2005 Lopez
6,897,806 B2 5/2005 Toshev
6,950,061 B2 9/2005 Howell et al.
6,999,036 B2 2/2006 Stoyanov et al.
7,061,432 B1 6/2006 Tavassoli Hozouri
7,253,777 B2 * 8/2007 Blaschke et al. ..... 343/713
7,382,329 B2 6/2008 Kim
7,385,562 B2 6/2008 Stoyanov et al.
7,492,322 B2 2/2009 Jung et al.
2001/0026245 A1 10/2001 Cipolla et al.
2002/0072955 A1 6/2002 Brock
2002/0128898 A1 9/2002 Smith et al.
2002/0194054 A1 12/2002 Frengut
2003/0067410 A1 * 4/2003 Puzella et al. ..... 343/700 MS
2003/0088458 A1 5/2003 Afeyan et al.
2003/0122724 A1 7/2003 Shelley et al.
2004/0178476 A1 9/2004 Boyanov et al.
2004/0233122 A1 11/2004 Espenscheid et al.
2005/0057396 A1 3/2005 Boyanov
2005/0146473 A1 7/2005 Stoyanov et al.
2005/0259021 A1 11/2005 Stoyanov et al.
2005/0259201 A1 11/2005 Hu et al.
2006/0132372 A1 6/2006 Jung et al.
2006/0197713 A1 9/2006 Mansour et al.
2006/0244669 A1 11/2006 Mansour et al.
2007/0146222 A1 6/2007 Mansour

FOREIGN PATENT DOCUMENTS

EP 0123350 10/1984
EP 0481417 4/1992
EP 0518271 12/1992
EP 0520424 12/1992
EP 0 546 513 A1 6/1993
EP 0 557 853 A1 9/1993
JP 62-173807 7/1987
JP 63-108805 5/1988
JP 06-3174411 7/1988
JP 63-171003 * 7/1988
JP 2-137402 5/1990
JP 3-247003 11/1991
JP 3-247003 A 11/1991
JP 6-69712 3/1994
JP 06-237113 8/1994
JP 8-321715 12/1996
WO 89/09501 10/1989
WO 00/75829 12/2000
WO WO 01/11718 A1 2/2001
WO 01/84266 11/2001
WO 02/19232 3/2002
WO 02/057986 7/2002
WO 02/103842 12/2002
WO WO 02/097919 A1 12/2002
WO 03/052868 6/2003
WO 03/096576 11/2003
WO 2004/042492 5/2004
WO 2004/075339 9/2004
WO 2004/079859 9/2004
WO 2004/079861 9/2004
WO WO 2004/075339 A2 9/2004
WO 2004/097972 11/2004
WO 2005/004284 1/2005
WO WO 2005/067098 A1 7/2005
WO 2007/046055 4/2007

WO 2007/063434 6/2007

OTHER PUBLICATIONS

Stuchly, et al., "Wide-Band Rectangular to Circular Waveguide Mode and Impedance Transformer," *IEEE Transactions on Microwave Theory and Techniques*, vol. 13, pp. 379-380 (May 3, 1965).
Israeli Office Action dated Feb. 25, 2007, re Israeli Application No. 154525, and English translation thereof.
Applicant's Response dated Mar. 3, 2008, to ISR and Written Opinion dated Oct. 9, 2007, re PCT/1B06/53805.
Applicant's Response to EPO dated Jun. 29, 2008, re EP 06809614.8.
International Search Report dated Jul. 30, 2008, re PCT/1B06/53806.
International Searching Authority Written Opinion dated Jul. 30, 2008, re PCT/IB06/53806.
Applicant's Response to EPO action dated Sep. 22, 2008, re EP 06809614.8.
Israeli Office Action dated Nov. 23, 2008, re Israeli Application No. 154525, and English translation thereof.
IPER dated Mar. 14, 2008, from the International Preliminary Examining Authority re PCT/IB20069/053805.
Communication Pursuant to Article 94(3) EPC dated Oct. 4, 2006, from the EPO re EP 04712141.3.
ISR dated Oct. 4, 2006, from the International Searching Authority re PCT/IB2006/053805.
Office Action dated Jul. 14, 2008, re U.S. Appl. No. 11/580,306.
Written Opinion dated Oct. 9, 2007, from the International Searching Authority re PCT/IB2006/053805.
Response dated Feb. 10, 2009, to the Communication Pursuant to Article 94(3) EPC dated Aug. 25, 2008, from the EPO re EP 06809614.8.
Response dated Jul. 14, 2008, to the Communication Pursuant to Rules 161 and 162 EPC dated May 26, 2008, from the EPO re EP 06809614.8.
Office Action dated Feb. 5, 2009, re U.S. Appl. No. 11/477,600.
Office Action dated Dec. 24, 2008, re U.S. Appl. No. 10/546,264.
English translation of Notification of Reasons of Rejection dated Jan. 21, 2009, from the JPO re JP 2006-502642.
Israeli Office Action dated Mar. 19, 2008, re IR 154525.
Communication Pursuant to Article 94(3) EPC dated Aug. 25, 2008, from the EPO re EP 06809614.8.
International Search Report mailed Oct. 14, 2004 in International Application No. PCT/IL04/00149.
International Search Report mailed Apr. 20, 2005 in International Application No. PCT/IL2005/000020.
Supplementary European Search Report completed Dec. 23, 2005 in European Application No. EP 04 71 2141.
European Patent Office Communication dated Oct. 4, 2006 in European Application No. EP 04 712 141.3.
Notification of Transmittal of International Preliminary Report on Patentability mailed May 27, 2005 in International Application No. PCT/IL04/00149.
Declaration of Messrs. Micha Lawrence and David Levy (Jan. 10, 2006) Including Exhibits re Sep. 9-12, 2003 Public Display in Seattle, Washington, USA.
Ito et al., "A Mobile 12 GHZ DBS Television Receiving System," IEEE Transactions on Broadcasting, vol. 35, No. 1, Mar. 1989, pp. 56-62.
Peeler et al., "A Two-Dimensional Microwave Luneberg Lens," I.R. E. Transactions—Antennas and Propagation, Jul. 1953, pp. 12-23.
Peeler et al., "Microwave Stepped-Index Luneberg Lenses," IRE Transactions on Antennas and Propagation, Apr. 1958, pp. 202-207.
Peeler et al., "Virtual Source Luneberg Lenses," I-R-E Transactions—Antennas and Propagation, Jul. 1954, pp. 94-99.
Felstead, "Combining Multiple Sub-Apertures for Reduced-Profile Shipboard Satcom-Antenna Panels," IEEE, Milcom 2001 Proceedings, Communications for Network-Centric Operations: Creating the Information Force, Oct. 28-30, 2001, XP010579091, pp. 665-669.
MR-Live, "MR-Live—Take the Pulse of Your Market", Product Overview, 11 P., 2001.
NetOnCourse "Harnessing the Value of Mass E-Gathering", <www.netoncourse.com>, 12 P., 2000.
NetOnCourse "NetOnCourse. Masters of Future Think", 4 P.
Communication Pursuant to Article 94(3) EPC Dated Jul. 22, 2009 From the European Patent Office Re.: Application No. 06809614.8.
Official Action dated Dec. 24, 2008 in U.S. Appl. No. 10/546,264.
Supplementary European Search Report and the European Search Opinion Dated Jul. 6, 2008 From the European Patent Office Re.: Application No. 06809615.5.
Communication Pursuant to Article 94(3) EPC Dated Oct. 28, 2008 From the European Patent Office Re.: Application No. 04712141.3.
Office Action Dated Nov. 23, 2008 From the Israeli Patent Office Re.: Application No. 154525.
Office Action Dated Feb. 25, 2007 From the Israeli Patent Office Re.: Application No. 154525.
Translation of notification of Reasons of Rejection Dated Jan. 21, 2009 From the Japanese Patent Office Re.: Application No. 2006-502642.
International Preliminary Report on Patentability Dated Jan, 22, 2009 From the International Bureau of WIPO Re.: Application No. PCT/IB2006/053806.
Office Action Dated May 3, 2009 From the Israeli Patent Office Re.: Application No. 171450 and Its Translation Into English.
Official Action Dated Jul. 24, 2008 From U.S. Appl. No. 11/580,306.
Response Dated Mar. 3, 2008 to the Search Report and Written Opinion of Oct. 9, 2007 From the International Searching Authority Re.: PCT/IB2006/053806.
Response Dated Dec. 15, 2008 to Official Action of Jul. 14, 2008 From U.S. Appl. No. 11/580,306.
Response Dated Sep. 22, 2008 to the Communication Pursuant to Article 94(3) EPC of Aug. 25, 2008 from the European Patent Office Re.: Application No. 06809614.8.
LeVine et al., "Component Design Trends—Dual-Mode Horn Feed for Microwave Multiplexing," Electronics, 27: 162-164, Sep. 1954.
Stuchly et al, "Wide-Band Rectangular to Circular Waveguide Mode and Impedance Transformer," IEEE Transactions on Microwave Theory and Techniques, 13:379-380, May 3, 1965.

* cited by examiner

DUAL POLARIZATION PLANAR ARRAY ANTENNA AND CELL ELEMENTS THEREFOR

BACKGROUND

1. Technical Field

The present invention relates to antennas and particularly to cavity backed antennas.

2. Related Art

One type of antenna suitable, for example, for satellite communication is planar array antennas. Planar array antennas are generally formed of an array of many (e.g., hundreds) cells, defined at least in part on printed circuit boards.

In a simple antenna, each cell includes a single electric probe, which either receives electromagnetic signals from a remote antenna (e.g., a satellite carried antenna) or transmits electromagnetic signals toward a remote antenna. A bottom reflective layer of the planar antenna reflects electromagnetic signals propagating downward, such that they reflect upwards toward the remote antenna.

It has been suggested to use a dual beam and dual polarization antenna, in which each cell includes two orthogonal electric probes, in separate layers, such that the probes share a common cell aperture. In order to prevent interference between the probes in a single cell, intra-cell isolation is required.

U.S. Pat. No. 5,872,545 to Rammos, the disclosure of which is incorporated herein by reference, describes such a dual beam and dual polarization antenna. Intra-cell isolation between the beams, however, is limited in the Rammos antenna and therefore the antenna can not be used in applications which are sensitive to signal polarization.

The problem of isolation between the beams of a single cell is compounded in relatively large planar arrays, which are used for transmissions over a relatively large bandwidth (e.g., for communications). In such arrays, also inter-cell isolation is required between the cells. In order to prevent interference between the cells, for example, each cell may be surrounded by a metallic frame. While such metallic frames improve the radiation efficiency of each cell, they interfere with the intra-cell isolation and make it even harder to use dual-polarization cells.

U.S. patent publication 2003/0122724 to Shelley et al., the disclosure of which is incorporated herein by reference, describes a planar array antenna with elements having two orthogonal probes. Features are described to increase isolation between the signals associated with each of the probes.

BRIEF SUMMARY

An exemplary embodiment relates to a microwave planar antenna including a plurality of radiating cells (referred to herein as radiators), having orthogonal excitation/reception probes in different layers. Each cell is surrounded by a metallic enclosure, which defines at least two different cross-sectional areas in a space between the excitation probes. In some embodiments, the different cross-sectional areas have distinctly different shapes. Alternatively or additionally, the different cross-sectional areas may differ in size. The cross sectional area of the enclosure in the space between the excitation probes may optionally be selected to allow maximal passage upwards of radiation from the lower excitation probe, while minimizing downward propagation of radiation from the upper excitation probe. Among other things, this arrangement reduces cross coupling from the upper probe downward, and increases the transmission and/or reception efficiency of the antenna.

The antenna may optionally include at least 10, 20, 50 or even 100 cells in a single antenna panel. In an exemplary embodiment, a single antenna panel may include over 200, 500 or even over a thousand cells. In some embodiments, the orthogonal electric probes may be capable of supporting two polarizations simultaneously.

Optionally, continuous electrical conductance is maintained along the entire height/depth of the cell enclosures, in order to improve the isolation between neighboring cells.

In some embodiments, the metallic enclosures of the cells are at least partially filled by dielectric fillers in order to lower the cutoff frequency of the cell and increase the cell's frequency response.

Optionally, several (e.g., 2-4) dielectric overlays may cover the tops of the cells in the transmission direction, to better match the cell's impedance with the open space impedance (377 ohms). This arrangement improves the radiation efficiency of the radiators and the array as a whole.

An aspect of some embodiments relates to a microwave planar antenna including a plurality of waveguide radiating cells having one or more layers (e.g., one or more cover layers) with different dielectric properties in different cells.

In some embodiments, the covers of different cells may have different dielectric properties according to average dielectric properties of a radome above each cell. Alternatively or additionally, different cells may have different dielectric properties in order to add a tilt angle to the view direction of the antenna.

In some embodiments, the covering dielectric layers may be parallel to the probes of the cells and differ in their dielectric value. Alternatively, some or all of the dielectric covers, of some or all of the cells, may be tilted at an angle relative to the probes of their respective cells. In some embodiments, at least some of the dielectric covers of at least some of the cells may have a non-uniform thickness and/or covers of different cells may have different thicknesses.

There is therefore provided in accordance with an embodiment of the invention, an RF antenna structure, comprising at least one radiation cell having a conductive enclosure and an upper probe and a lower probe located at different heights within the enclosure, the enclosure between the upper probe and a bottom of the cell has at least two different cross-sectional areas. Optionally, the antenna structure includes at least 16 radiation cells or even at least 64 radiation cells. Optionally, the conductive enclosure isolates waves generated within the at least one cell from neighboring cells of the antenna structure. Optionally, the conductive enclosure comprises a substantially continuous metallic enclosure. Optionally, the upper and lower probes are oriented at substantially 90° relative to each other. Optionally, the antenna comprises a planar array antenna structure. Optionally, an upper portion of the enclosure beneath the upper probe has a longer width than a lower portion of the enclosure. Optionally, the upper portion has a width which allows propagation of waves generated by the upper probe of frequencies at least as low as 12 GHz, while the lower portion imposes a cut-off frequency which does not allow propagation of waves from the upper probe of frequencies lower than 13 GHZ.

Optionally, the at least one radiation cell is adapted for transmission of waves of a predetermined frequency band and wherein the upper portion allows propagation of waves generated by the upper probe in the predetermined frequency band while the lower portion does not substantially allow propagation of waves generated by the upper probe, in the predetermined frequency band.

The lower portion of the enclosure is above the lower probe or below the lower probe. Optionally, the height of the upper portion of the enclosure is substantially equal to a quarter wavelength of a frequency that can pass through the upper portion but is blocked from passing below the upper portion. Optionally, the cross sectional area of the cell between the upper and lower probes is smaller than 100 square millimeters. Optionally, the cross-sectional area of the cell within the enclosure has a capital "T" shape over at least part of its height. Optionally, the antenna structure includes at least one dielectric cover above the cell conductive enclosure. Optionally, the at least one dielectric cover above the cell effectively isolates the cell from dirt and humidity in the environment. Optionally, the at least one dielectric cover is not perpendicular to a beam direction of the cell. Optionally, the at least one dielectric cover has a non-uniform thickness. Optionally, the enclosure comprises a metal ridge, smaller than the upper probe, serving as a single ridge waveguide structure.

There is further provided in accordance with an embodiment of the invention, a planar antenna array having a transmitting face and comprising a plurality of arrayed cells each cell comprising a first antenna probe, a second antenna probe spaced away from the first antenna and a reflector structure situated between the first and second antenna probes that is configured to pass RF waves transmitted/received by the second antenna probe and to reflect RF waves transmitted/received by the first antenna probe.

Optionally, the first antenna probe has a first RF polarization and the second antenna probe has a different RF polarization. Optionally, the reflector structure includes a waveguide section that passes RF waves with the polarization of the second antenna probe but is cut-off for RF waves with the polarization of the first antenna probe. Optionally, the reflector structure is spaced at a distance from the first antenna probe such that RF waves reflected from the reflector structure reinforce RF waves generated or received at the first antenna probe. Optionally, the first and second antenna probes are oriented perpendicular to each other.

BRIEF DESCRIPTION OF FIGURES

Particular non-limiting exemplary embodiments will be described with reference to the following description in conjunction with the figures. Identical structures, elements or parts which appear in more than one figure are preferably labeled with a same or similar number in all the figures in which they appear, in which.

DETAILED DESCRIPTION OF EXEMPLARY EMBODIMENTS

General Structure

Figure 1:
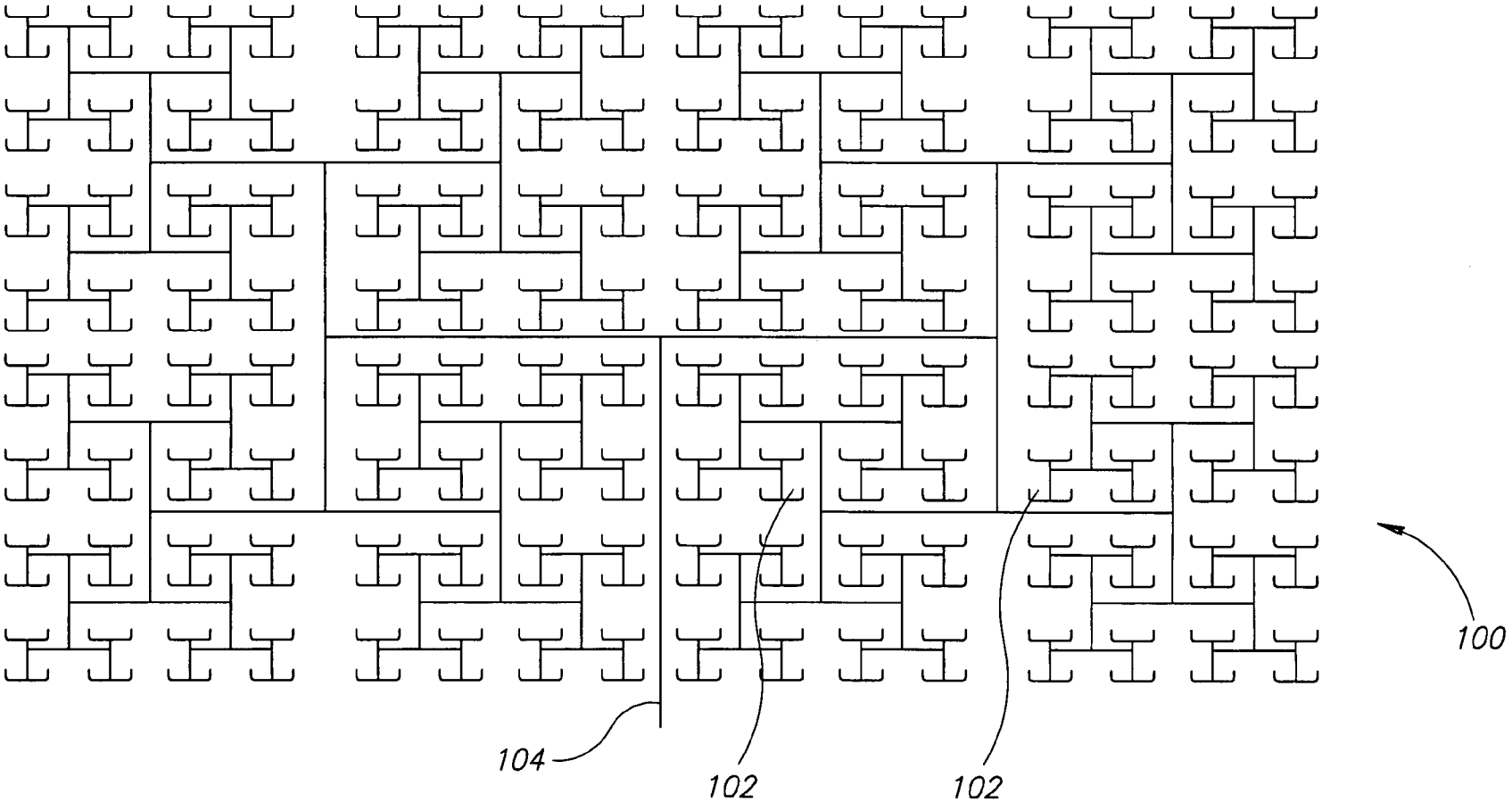
FIG. 1 is a schematic layout of a corporate feed conductor array for an antenna panel, in accordance with an exemplary embodiment.

FIG. 1 is a schematic top view layout of a corporate conductive feed array for an exemplary antenna panel 100, in accordance with an exemplary embodiment. Antenna panel 100 includes a plurality of cells 102 at the distal end of each feed point which are connected in a corporate array of feed lines to a central single main feed line 104, in what is commonly referred to as a corporate feed network (CFN). Although only one CFN is shown in FIG. 1, antenna panel 100 typically includes two CFNs in two parallel layers. The CFNs are optionally separated by an isolating layer and are optionally sandwiched between isolating layers. Optionally, the CFN may be realized with micro-strip lines, suspended strip lines and/or waveguides, although other physical structures for RF transmission lines may be used.

In some embodiments, antenna panel 100 includes at least 16, 20 or even at least 50 (e.g., 64) cells. Optionally, antenna panel 100 includes at least 100, 250 or even at least 500 cells. Possibly, antenna panel 100 includes over 1000 or even over 1500 cells. Suggested practical numbers of cells for some exemplary embodiments are 128, 144, 256 and 576 and/or other numbers that are preferably divisible by 16 and/or are squares of other numbers.

Each cell optionally may have an area of less than 2 square centimeters, less than 1.4 centimeters or even not more than 1 square centimeter. Optionally, antenna 100 can be used for efficient data transmission and/or reception over a large frequency band, for example at least 1 GHz or even at least 4 or 5 GHz, when designed for Ku-band operation. In some embodiments, the antenna may have a bandwidth of less than 8 GHz, less than 6 GHz and in some cases less than 4 GHz. Antenna 100 optionally can be used for transmission with a relative bandwidth greater than 10%, 20% or even greater than 30%. In an exemplary embodiment, antenna 100 is designed to operate with a central frequency within the Ku band, i.e., the band between 10-18 GHz, and an absolute bandwidth of at least 3 GHz or even at least 3.5 GHz, for example about 3.8 GHz. Optionally, the antenna may be designed for the 10.7-14.5 GHz band.

In some embodiments, each cell 102 has a gain of between about 5-8 dB, for example 6 dB, although cells with other gains may be used. Optionally, antenna panel 100 may include a sufficient number of cells to achieve a total gain of at least 20 dB, 25 dB or even at least 30 dB.

In RF signal transmission, a data-carrying electrical RF signal to be transmitted may be fed to central feed line 104, from which the signal may be distributed to all of cells 102 through the CFN. In some embodiments, the electrical signal may be distributed evenly (e.g., equal in magnitude and in relative phase) to each of cells 102. Each of cells 102 generates a propagating RF electromagnetic wave from the electrical signals, such that the RF waves emanating from all of cells 102 combine into an RF electromagnetic beam propagation pattern having an equal-phase wave front, and having sufficient strength for communication with a remote receiver, such as on a satellite. As will be understood, a reciprocal procedure in the opposite direction occurs when antenna panel 100 receives RF waves from a remote transmitter.

Figure 2:
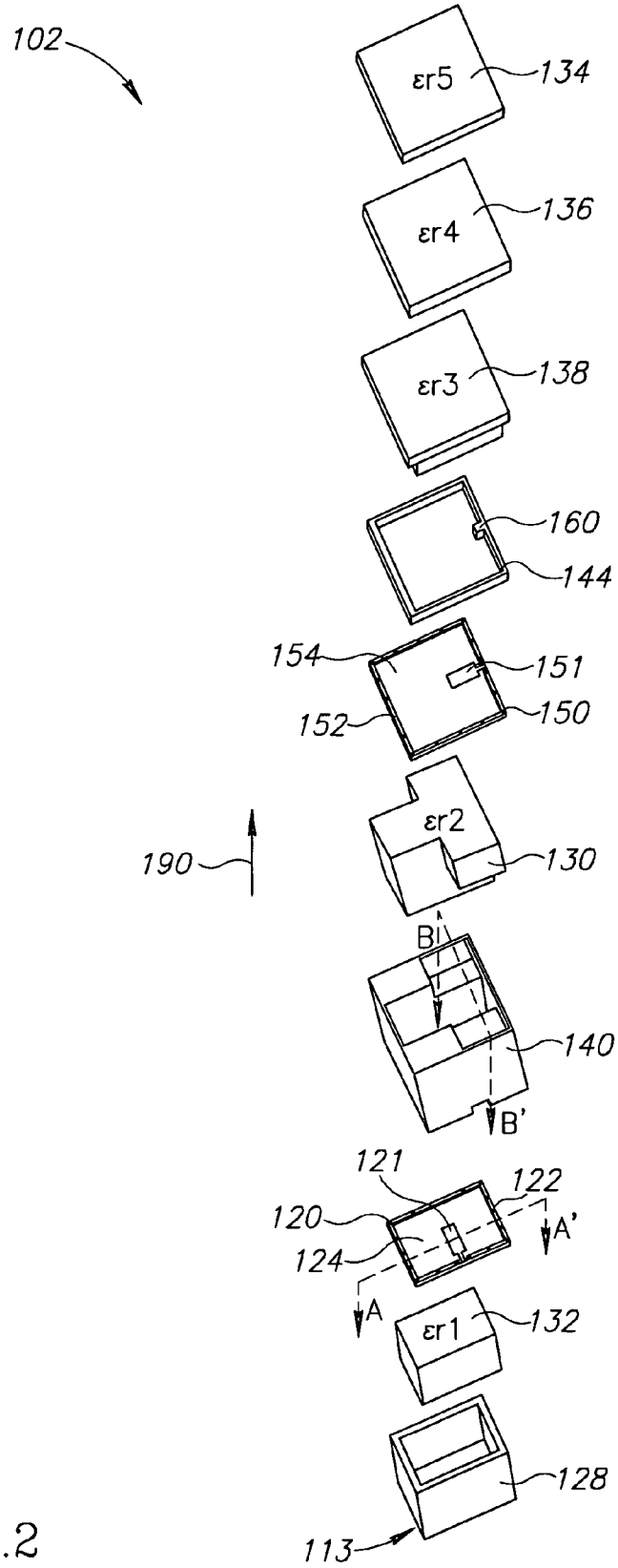
FIG. 2 is an exploded view of a radiation cell, in accordance with an exemplary embodiment.

FIG. 2 is an exploded perspective view of one of cells 102, in accordance with an exemplary embodiment. Cell 102 includes an upper electrical probe 151 and a lower electrical probe 121. Probes 151 and 121 convert RF electrical signals into propagating RF electromagnetic waves (e.g., microwaves) for transmission and convert received RF microwaves into RF electrical signals in reception. Upper electrical probe 151 is located within a metal frame 150, which isolates upper probe 151 from its surroundings, e.g., other cells 102. Similarly, lower probe 121 is optionally located within a metal frame 120, for inter-cell isolation.

In some embodiments, cell 102 is surrounded by metal isolation over most of its height or even its entire height, in order to achieve good isolation from neighboring cells. As shown in FIG. 2, the isolation optionally includes, in addition to frames 150 and 120, a central enclosure 140 between probes 151 and 121, a lower enclosure 128 below lower probe 121 and an upper enclosure 144 above upper probe 151. Optionally, enclosures 128, 140 and/or 144 are formed of continuous metal walls. Alternatively or additionally, one or more of the enclosures may have a metal mesh structure. Other parts of exemplary cell 102 are described below.

Probes

Probes 121 and 151 are optionally quarter wavelength monopole radiating elements. Alternatively, probes 121 and 151 may be of any other type of radiating element known in the art as useful for panel antennas, such as any of the probes described in above mentioned U.S. Pat. No. 5,872,545 to Rammos. In some embodiments, probes 151 and 121 are formed on respective dielectric substrates 154 and 124 located within the respective frames 150 and 120 of the probes (e.g., thin PCB substrate for each cell or a larger substrate with formed arrays of conductive traces 151, 121, 150, 120 for each cell). In an exemplary embodiment, probes 151 and 121 are made of copper, although other conductive metals, such as silver or gold, may be used.

Probes 121 and 151 optionally have a rectangular shape, for ease of design and/or electrical operation. In some embodiments, probes 121 and 151 have a length which is at least 50%, at least 65% or even at least twice their widths. Optionally, probes 121 and 151 are both of the same size, so as to operate with antenna gains of the same magnitudes and/or frequency response. Alternatively, probes 121 and 151 may have different sizes, for example corresponding to respective different wavelengths with which they are to operate. In an exemplary embodiment, probes 121 and 151 are about 2.5 mm long and about 1.5 mm wide.

Probes 121 and 151 are preferably orthogonal to each other, creating a 90° rotation in polarization between the propagating RF electromagnetic waves generated (or detected) by the probes. It will be understood that the probes are connected to a respective distal feed point of a CFN. The probe and/or its feed line pass through a small gap in the surrounding metal cell frame and are thus not shorted out to the grounded frame. In an exemplary embodiment, upper frame 150 has a square shape, with upper probe 151 extending perpendicular from the middle of one of its sides. Lower probe 121 is optionally parallel to the side of frame 150 from which probe 151 extends, although below the frame. Optionally, upper fame 150 is symmetrical around the long axis of probe 151 and around the long axis of probe 121.

Frames

Figure 3:
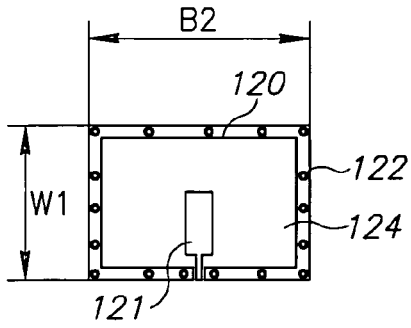
FIG. 3 is a schematic top view of an excitation probe of an antenna, within its respective frame, in accordance with an exemplary embodiment.

FIG. 3 is a schematic illustration of probe 121, within its respective frame 120, in accordance with an exemplary embodiment. Frame 120 is optionally formed on an outer periphery of substrate 124, possibly on both faces of the substrate. In some embodiments, the portions of frame 120 on the opposite faces of substrate 124 are connected by metal which covers the thickness (the outer edge) of the substrate. Alternatively or additionally, one or more via holes 122 passing through substrate 124 electrically connect portions of frame 120 on opposite faces of substrate 124. Optionally, frame 120 comprises copper, although any other suitable conductive metal (e.g., silver, gold) may be used. In some embodiments, frame 120 comprises copper coated by another metal, such as silver or gold.

In some embodiments, substrate 124 comprises a microwave insulating material having a constant predetermined permittivity, for example a permittivity between about 2-2.6, for example 2.2 or 2.3. In an exemplary embodiment, R/T Duroid 5880 available from the Rogers Corporation from Connecticut is used as the insulating substrate material.

Frame 150 (FIG. 2) optionally has a similar structure to that of frame 120, including a substrate 154 similar to substrate 124, and via holes 152 similar to via holes 122 in frame 120. In contrast, in some embodiments, upper frame 150 has a different size and/or shape, than lower frame 120.

Dielectric Fillers

In some embodiments, some or all of the internal volumes of cell 102, e.g., as defined by enclosures 140 and 144, are filled with respective dielectric fillers. In an exemplary embodiment, lower enclosure 128 is filled by a lower filler 132 (FIG. 2), having a dielectric permittivity of $\epsilon_{r1}$, upper enclosure 144 is filled by an upper filler cover 138 having a dielectric permittivity of $\epsilon_{r3}$ and central enclosure 140 is filled by a central filler 130, having a dielectric permittivity $\epsilon_{r2}$.

Optionally, dielectric fillers 132, 138 and 130 have the same relative dielectric permittivity values, i.e., $\epsilon_{r1}=\epsilon_{r2}=\epsilon_{r3}$. Alternatively, different ones of the fillers may have different permittivity values, to better match impedance for the specific wavelength(s) for which probes 121 and 151 are designed. In an exemplary embodiment, $\epsilon_{r1}=\epsilon_{r2}=3$ and $\epsilon_{r3}$ is between 3 and 4.

Propagation Path from Lower Probe

Frame 120 is optionally sufficiently large so as not to interfere with generation and/or transmission of propagating RF microwave signals from lower probe 121. In an exemplary embodiment, for Ku band transmission, frame 120 has a length B2 (FIG. 3) greater than 8 millimeters or even greater than 9 millimeters (e.g., 10 millimeters). Optionally, length B2 is not substantially larger than required (e.g., using conventional rectangular waveguide design criteria) to allow the waves to propagate upwards, so as to minimize the size of each cell 102 and hence maximize the number of cells included in a given area. In some embodiments, length B2 is not more than 20%, or even not more than 10%, greater than the minimal length required to allow wave propagation. In an exemplary embodiment, for Ku band transmission, frame 120 has a length B2 smaller than 12 millimeters, smaller than 11 millimeters, or even smaller than 10 millimeters. Probe 121 is optionally located in the middle of the length B2 of the frame.

Frame 120 optionally has a width W1 (FIG. 3) which is sufficiently large not to interfere with generation and/or transmission of RF microwave signals propagating to/from lower probe 121. In an exemplary embodiment, for Ku band transmission, frame 120 has a width of at least 3, 4 or even 5 millimeters. Thus, in some embodiments, probes 121 and/or 151 have a length of at least 40%, 50% or even 70% of the length of their respective frames 120 and 150.

Figure 4:
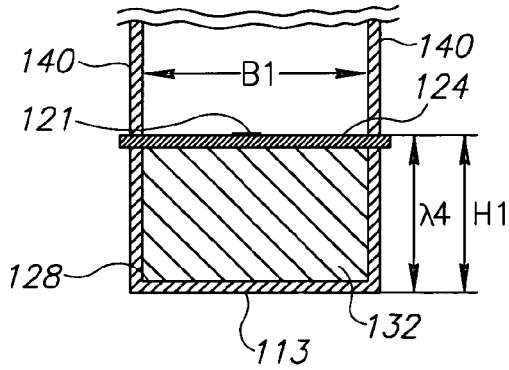
FIG. 4 is a cross-sectional view, taken parallel to the front of the exemplary antenna along dashed line A-A' in FIG. 2, of a lower enclosure and its respective dielectric filler, in accordance with an exemplary embodiment.

FIG. 4 is a cross-sectional illustration of cell 102, along line A'-A' of FIG. 2, in accordance with an exemplary embodiment. Optionally, the outer walls of enclosures 140 and 144 (FIG. 2) and frame 150, which are located within cell 102 above frame 120 in the direction of arrow 190 (FIG. 2), are not located above the area defined by frame 120, in order not to interfere with the propagation of waves to/from lower probe 121. In some embodiments, above lower probe 121, cell 102 has a length B1 (FIG. 4) substantially equal to length B2, in order to minimize the size of cell 102. Alternatively, length B1 is larger than length B2, for example by at least 5% or even 10%.

The volume defined by lower enclosure 128 together with the thickness of substrate 124 optionally has a height H1 (FIG. 4), which is selected such that a bottom surface 113 of enclosure 128 mirrors back microwave signals generated by lower probe 121 that propagate downward. Thus, instead of half the energy of the generated waves propagating downwards, while only half the generated microwaves propagate upward in the transmission direction of the antenna, the reflection by bottom surface 113 causes substantially all the energy of the generated microwaves to propagate in the transmission direction (designated by arrow 190 in FIG. 2). In some embodiments, the height H1 between bottom surface 113 and probe 121 is selected as a quarter of the wavelength ($\lambda/4$) of a representative frequency (e.g., a central frequency of the intended bandwidth of the antenna) of the waves generated (or received) by probe 121, such that the distance propagated by the downward traveling signals until they return to probe 121 is $\lambda/2$. The downward propagating microwave signals from probe 121 also undergo a phase shift of 180° degrees (equivalent to a travel of $\lambda/2$) when they are reflected from a bottom surface 113 of enclosure 128, such that the returning signals undergo a total phase shift of 360° degrees (equivalent to a travel of a full $\lambda$), which is equivalent to no phase shift at all.

Enclosure 128 optionally has the same length as the length B2 of frame 120, so that the waves throughout the area of frame 120 are allowed to propagate downward through height H1.

Propagation Path from Upper Probe

The internal volume of cell 102 defined by central enclosure 140 (FIG. 2) is optionally designed in a manner which allows downward propagation of microwave signals from upper probe 151 only to a limited extent, such that the downward propagating waves are reflected upward in a manner which constructively combines with waves originally propagating upwards from probe 151. As earlier mentioned, the design is also such that it allows passage therethrough of microwaves from lower probe 121 upwards.

Figure 5:
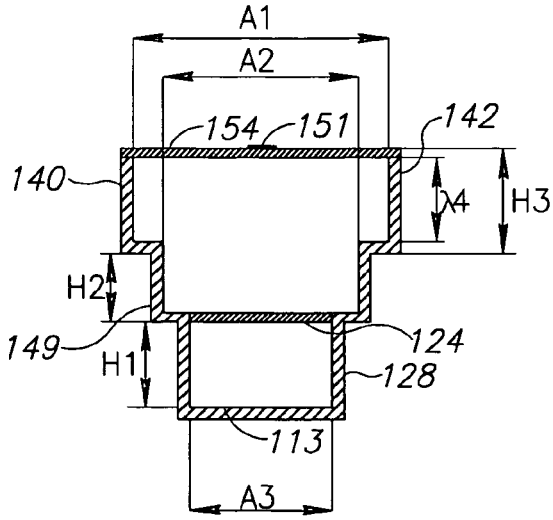
FIG. 5 is a cross-sectional view of the exemplary radiation cell of FIG. 2 beneath its upper probe, along dashed line B-B' in FIG. 2, in accordance with an exemplary embodiment.

FIG. 5 is a cross-sectional view of the height of cell 102 beneath upper probe 151, along line B-B' of FIG. 2, in accordance with an exemplary embodiment. Immediately beneath upper probe 151 and frame 150, an upper portion 142 of enclosure 140 has a width A1, which allows unobstructed generation and propagation of waves from upper probe 151, in the intended frequency band of antenna panel 100. In an exemplary embodiment, width A1 is greater than 8 millimeters or even greater than 9 millimeters. Optionally, A1 is about 10 millimeters. In some embodiments, width A1 is substantially equal to length B1.

A mid-portion 149 of enclosure 140 optionally has a smaller width A2, which imposes a waveguide cutoff frequency that prevents downward propagation of waves generated by upper probe 151 into mid-portion 149 of enclosure 140. Thus, mid-portion 149 serves as an evanescent-mode waveguide for signals generated by upper probe 151. In an exemplary embodiment, width A2 is less than 8 millimeters or even less than 7 millimeters, optionally depending on the specific wavelengths for which the antenna panel is designed. For example, a width which blocks frequencies below 14.5 GHz may be used in a Ku band antenna. In some embodiments, upper portion 142 has a height H3, which is selected as a quarter of the wavelength ($\lambda/4$) of a representative frequency of the waves generated (or received) by probe 151, as discussed above regarding height H1 with respect to lower probe 121.

Thus, in some embodiments, enclosure 140 between upper probe 151 and lower substrate 124 has at least two different widths (A1 and A2). Width A1 of the upper portion is optionally used in order not to interfere with the operation of upper probe 151, while width A2 of the lower mid-portion prevents down propagation of waves from probe 151.

Optionally, enclosure 128 has a still lower width A3, which is even smaller than width A2 of mid-portion 149, in order to provide gradual increase in the width of cell 102 (i.e., a better impedance matching) and thus reduce signal reflections downward of upward traveling waves from lower probe 121. In an exemplary embodiment, width A3 of enclosure 128 is about 5 millimeters.

In other embodiments, width A2 is larger than required to impose a cutoff frequency, but width A3 of enclosure 128 is sufficiently small to prevent downward propagation of waves from upper probe 151. Optionally, in these embodiments, the height H2 of mid-portion 149 is equal to a quarter of the wavelength of a mid-band frequency of the microwave signals for which antenna 100 is to operate, so that signals propagating downwards from probe 151 are reflected upwards such that they have the same phase as generated signals initially propagating upwards from probe 151.

As shown, the width W1 of frame 120 is equal to width A2 of mid-portion 149. In other embodiments, the width W1 of frame 120 is equal to width A3 of enclosure 128 or is equal to an intermediate width between A2 and A3.

Central Enclosure

In addition to having a changing width, at least in the direction orthogonal to upper probe 151, the internal volume of central enclosure 140 and/or of filler 130 optionally has a cross-sectional shape which changes along the height of cell 102 (indicated by arrow 190), between upper probe 151 and lower probe 121 (FIG. 2). In some embodiments, the internal volume of central enclosure 140 and/or of filler 130 has at least two different cross-sectional shapes along the height of the cell. Optionally, near lower probe 121, the internal volume of central enclosure 140 and/or of filler 130 (FIG. 2) has a rectangular cross-sectional shape, for example similar to the shape of lower frame 120. In some embodiments, near lower probe 121, the internal volume of central enclosure 140 and/or of filler 130 is symmetrical around an axis passing through the length of lower probe 121. Optionally, the cross sectional shape near lower probe 121 is also symmetric about an axis passing through probe 151.

Near upper probe 151 the internal volume of central enclosure 140 and/or of filler 130 optionally has a capital "T" shape, which is symmetric about an axis passing through upper probe 151 but is not symmetric about an axis passing through lower probe 121. Alternatively to the "T" shape, upper portion 142 may have a rectangular, possibly square, cross section, defined by width A1 and length B1. This alternative is optionally used when an antenna panel with a tilted beam is desired, as a square shape causes a squint (i.e., tilt angle in beam angle) in the waves generated by upper probe 151.

In some embodiments, frame 150 has the same size and shape as upper portion 142 of central enclosure 140. Alternatively, for simplicity, frame 150 may have a square shape, regardless of the shape of upper portion 142. In some embodiments, frame 150 is thin (along height 190 in FIG. 2) relative to enclosure 140 and therefore the shape of frame 150 is less important than the shape of enclosure 140. Optionally, enclosure 140, frame 150 and/or other enclosures and frames of cell 102 have walls which intersect at 90° angles. Alternatively to 90° angles, rounded shapes may be used, for example with a 0.5 millimeter radius in at least some of its corners. The use of rounded corners allows in some cases simpler production.

Upper Enclosure

In some embodiments, upper enclosure 144 (FIG. 2) has a square shape, which allows passage of signals from both of probes 121 and 151, and allows relatively more simple production. Alternatively, upper enclosure 144 has a shape similar to the cross-section of upper portion 142 of enclosure 140, minimizing the area of cell 102.

Optionally, upper enclosure 144 includes a small metal ridge 160 (FIG. 2), forming a single-ridged waveguide, which improves the cell gain for lower frequencies of the frequency range. Ridge 160 optionally reduces the cutoff frequency of upper enclosure 144 and hence increases the bandwidth of cell 102.

Metal ridge 160 is optionally small enough not to cover a substantial portion of upper probe 151. Optionally, metal ridge 160 does not cover more than 20% or even more than 10% of upper probe 151. In an exemplary embodiment, metal ridge 160 does not cover any of probe 151. In some embodiments, metal ridge 160 protrudes from upper enclosure 144 not more than 1.5 millimeters, not more than 1 millimeter or even not more than 0.5 millimeters. Optionally, ridge 160 protrudes from upper enclosure 144 by at least 0.2 or even at least 0.4 millimeters. Metal ridge 160 optionally has a width of more than 1 millimeter, more than 1.5 millimeters or even more than 1.8 millimeters.

In some embodiments, the dielectric value $\epsilon_{r3}$ of filler cover 138 (FIG. 2) is selected based on the requirements of the higher frequencies of the bandwidth range for which antenna panel 100 is designed, while metal ridge 160 corrects for the lower frequencies of the range.

Overlay Covers

In some embodiments, above upper dielectric filler cover 138, cell 102 includes one or more dielectric overlay covers 134 and 136 (FIG. 2), which serve to improve impedance matching between cell 102 and surrounding space (e.g., the atmosphere). The improved impedance matching optionally reduces signal reflections between cell 102 and the atmosphere. The dielectric values of covers 134 and 136 are optionally selected for improved impedance matching, using methods known in the art.

Figure 6:
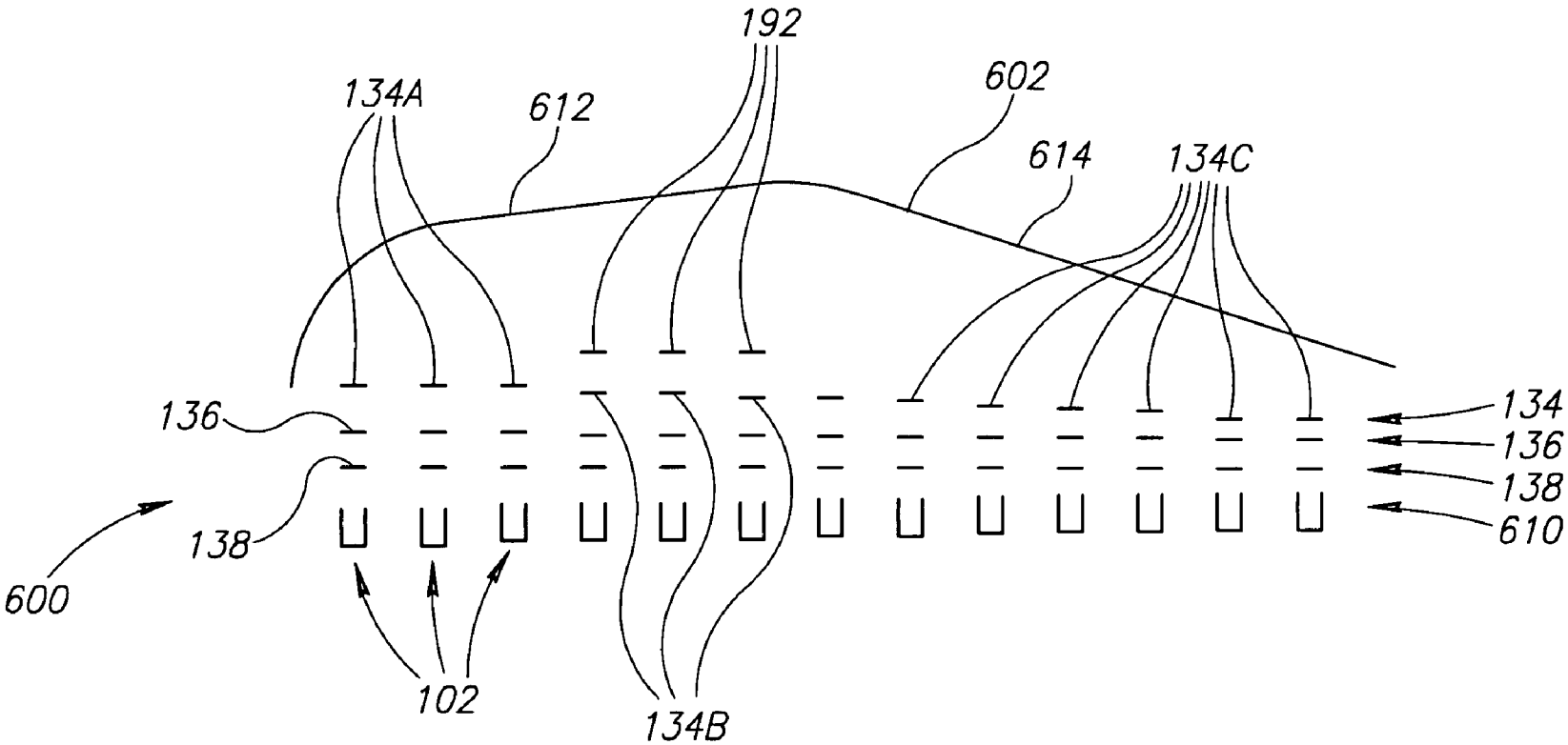
FIG. 6 is a schematic sectional view of an antenna panel beneath a radome, in accordance with an exemplary embodiment.

FIG. 6 is a schematic sectional view of an antenna panel 600 beneath a radome 602, in accordance with an exemplary embodiment. Antenna panel 600 comprises a plurality of cells 102, each of which includes a main body 610 (e.g., including enclosures 128, 140 and 144) and overlay covers 134 (marked 134A, 134B and 134C in FIG. 6), 136 and 138. Alternatively, one or more cells 102 include fewer overlay covers or more overlay covers, for example including an additional overlay cover 192.

Radome 602 optionally seals antenna panel 600 from external humidity, dust and/or other interfering particles of the environment.

In some embodiments, the covers 134 of different cells have different dielectric properties. Optionally, the covers 134 have dielectric properties at least partially selected according to the average dielectric properties of the radome above each cell. In an exemplary embodiment, covers 134A of cells located under a front portion 610 of radome 602 have first dielectric value, covers 134B of cells beneath a central portion 612 of radome 602 have a second dielectric value, and covers 134C of cells 102 beneath a rear portion 614 of radome 602 have a third dielectric value. This embodiment is optionally used, when antenna panel 600 is not rotated, or is rotated together with radome 602.

In some embodiments, antenna panel 600 is rotated relative to radome 602. The dielectric values of covers 134 are optionally selected, among other factors, according to the average dielectric value of the radome above the cell.

The variations in the dielectric properties may be achieved in many methods, one or more of which may be used as appropriate. In some embodiments, dielectric covers 134 are parallel to the probes of the cells 102 and differ in their dielectric value, for example the material from which they are formed. Alternatively or additionally, the dielectric covers 134 of different cells 102 differ in their dimensions, for example in their thickness. Further alternatively, some or all of the dielectric covers 134, of some or all of the cells 102, are tilted at an angle relative to the probes of the cells. In some embodiments of the invention, at least some of the dielectric covers 134 of at least some of the cells have a non-uniform thickness and/or covers of different cells have different thicknesses.

While the above description relates to variations in the dielectric values of covers 134, in some embodiments there are also, or alternatively, variations in the dielectric values of covers 136 and/or 138.

It is noted that the use of covers 134 having different dielectric properties is not limited to use in matching radome properties but may be used for other purposes, such as adding a tilt to the beam direction of the antenna panel, such that the beam direction is not perpendicular to the surface of the antenna panel.

CONCLUSION

It is noted that although the above discussion relates in many places to transmission of signals by probes 151 and 121, the same principles generally govern the reception of signals by the probes and one or both of the probes may be used for signal reception.

Antennas in accordance with the above described embodiments may be used for substantially any type of communications required, including direct broadcast television satellite (DBS) communications and/or Internet access through satellite. The antennas may be used with fixed orbital position (geostationary) satellites, low orbit satellites and/or any other satellites.

An antenna panel structure as described herein may be used as each sub-panel in a split-panel array as described in co-pending U.S. application Ser. No. 10/546,264 filed Aug. 18, 2005 which is the U.S. national phase of PCT/IL2004/000149 filed Feb. 18, 2004, the disclosure of which is incorporated herein by reference.

In an exemplary embodiment, the above described antenna panels are used for microwave signals in dual-polarizations, for example using both horizontal and vertical polarizations, and/or one or both of RHCP and LHCP (Right-Hand-Circular-Polarization & Left-Hand-Circular-Polarization), or propagating RF electromagnetic waves having any other desired polarization. In some embodiments, the beam direction of the antenna panel is perpendicular to the surface of the antenna. Alternatively, the beam direction may be squinted and/or tilted relative to a perpendicular to the surface of the antenna panel.

It will be envisioned that the above described apparatus may be varied in many ways, including, changing the materials used and the exact structures used. The number of substrate layers may be adjusted, for example placing the probes and frames on different substrates. Substantially any suitable production method for the antenna may be used. It should also be appreciated that the above described description of methods and apparatus are to be interpreted as including apparatus for carrying out the methods and methods of using the apparatus.

The above exemplary embodiments have been described using non-limiting detailed descriptions that are provided by way of example and are not intended to limit the scope of the invention claimed hereinafter. It should be understood that features and/or steps described with respect to one embodiment may be used with other embodiments and that not all embodiments have all of the features and/or steps shown in a particular figure or described with respect to one of the embodiments.

It is noted that some of the above described embodiments describe the best mode contemplated by the inventor and therefore include structure, acts or details of structures and acts that may not be essential to the invention and which are described merely as examples. Structure and acts described herein are replaceable by equivalents which perform the same function, even if the structure or acts are different, as known in the art. Therefore, the scope of the invention is limited only by the elements and limitations as used in the claims. When used in the following claims, the terms "comprise", "include", "have" and their conjugates mean "including but not limited to".

What is claimed is:

1. An RF antenna structure, comprising:

at least one radiation cell having a conductive central enclosure and an upper probe and a lower probe located at different heights within the central enclosure, wherein the central enclosure between the upper probe and a bottom of the cell has at least two different cross-sectional areas, further comprising a conductive upper enclosure above the upper probe, and wherein the upper enclosure comprises a metal ridge partially overlapping the upper probe, but being smaller in area than the upper probe, serving as a single ridge waveguide structure.

2. An RF antenna structure as in claim 1 comprising at least 16 said radiation cells.

3. An RF antenna structure as in claim 2, wherein the conductive central enclosure isolates waves generated within the at least one cell from neighboring cells of the antenna structure.

4. An RF antenna structure as in claim 2 comprising at least 64 said radiation cells.

5. An RF antenna structure as in claim 1, further comprising a conductive upper enclosure above the upper probe and a conductive lower enclosure below the lower probe, and wherein the conductive upper, central and lower enclosures comprise a substantially continuous metallic enclosure.

6. An RF antenna structure as in claim 1 wherein the upper and lower probes are oriented at substantially 90° relative to each other.

7. An RF antenna structure as in claim 1, wherein the antenna structure comprises a planar array antenna structure.

8. An RF antenna structure as in claim 1, wherein an upper portion of the central enclosure beneath the upper probe has a longer width than a lower portion of the central enclosure.

9. An RF antenna structure as in claim 8 wherein the upper portion has a width which allows propagation of waves generated by the upper probe of frequencies at least as low as 12 GHz, while the lower portion imposes a cut-off frequency which does not allow propagation of waves from the upper probe of frequencies lower than 13 GHz.

10. An RF antenna structure as in claim 8 wherein the at least one radiation cell is adapted for transmission of waves of a predetermined frequency band and wherein the upper portion allows propagation of waves generated by the upper probe in the predetermined frequency band while the lower portion does not substantially allow propagation of waves generated by the upper probe, in the predetermined frequency band.

11. An RF antenna structure as in claim 8, wherein the lower portion of the central enclosure is above the lower probe.

12. An RF antenna structure as in claim 8, further comprising a conductive lower enclosure below the lower probe.

13. An RF antenna structure as in claim 8, wherein the height of the upper portion of the central enclosure is substantially equal to a quarter wavelength of a frequency that can pass through the upper portion but is blocked from passing below the upper portion.

14. An RF antenna structure as in claim 1 wherein the cross sectional area of the cell between the upper and lower probes is smaller than 100 square millimeters.

15. An RF antenna structure as in claim 1, wherein one of said at least two different cross-sectional areas has a capital "T" shape.

16. An RF antenna structure as in claim 1, comprising at least one dielectric cover above the cell conductive upper enclosure.

17. An RF antenna structure as in claim 16 wherein the at least one dielectric cover above the cell effectively isolates the cell from dirt and humidity in the environment.

18. An RF antenna structure as in claim 16, wherein the at least one dielectric cover is not perpendicular to a beam propagation direction of the cell.

19. An RF antenna structure as in claim 16 wherein the at least one dielectric cover has a non-uniform thickness.

20. An RF antenna structure as in claim 1, further comprising a conductive upper enclosure above the upper probe.

21. An RF antenna structure as in claim 1, wherein said upper probe has a first RF polarization and said lower probe has a different RF polarization.

22. An RF antenna structure as in claim 21, wherein said conductive central enclosure includes a waveguide section that passes RF waves with said polarization of said lower probe but is cut-off for RF waves with said polarization of said upper probe.

23. An RF antenna structure as in claim 22, wherein said conductive central enclosure is spaced at a distance from said upper probe such that RF waves reflected from said conductive enclosure reinforce RF waves generated or received at said upper probe.

24. An RF antenna structure as in claim 1, having a relative bandwidth greater than 30%.

25. An RF antenna structure as in claim 1, wherein a width of said lower portion imposes a cutoff frequency that prevents propagation of RF waves transmitted/received from said upper probe towards said lower probe.

26. An RF antenna structure as in claim 1, wherein a cross-sectional area of an upper portion of said central enclosure comprises a first rectangular area abutted in its mid-section by a perpendicular second rectangular area.

* * * * *